United States Patent [19]

McCartney

[11] 4,000,408

[45] Dec. 28, 1976

[54] VEHICULAR ELECTRICAL SAFETY APPARATUS

[75] Inventor: Leo McCartney, Mokelumne Hill, Calif.

[73] Assignee: Lawrence Peska Associates, Inc., New York, N.Y. ; a part interest

[22] Filed: June 3, 1975

[21] Appl. No.: 583,259

[52] U.S. Cl. ..... 307/10 BP; 340/52 H; 180/103 A; 200/61.45 R

[51] Int. Cl.[2] ..... H01H 35/14

[58] Field of Search ..... 200/61.45 R; 180/82 R, 180/103; 340/262, 261, 52 H; 307/10 R, 10 BP

[56] References Cited

UNITED STATES PATENTS 3,251,033 5/1966 Lawyer ..... 340/52 H

*Primary Examiner*—Herman T. Hohauser

[57] ABSTRACT

This disclosure pertains to apparatus mounted to the frame of a vehicle, sensitive to impacts exceeding a predetermined level. The impact device disables a main control relay which feeds all of the electrical circuitry of the vehicle. Turning the ignition switch to the "off" position also de-energizes the main control relay in the same fashion as the impact device further insuring that all electrical circuits in the vehicle are fully disabled.

5 Claims, 4 Drawing Figures

FIG. 1
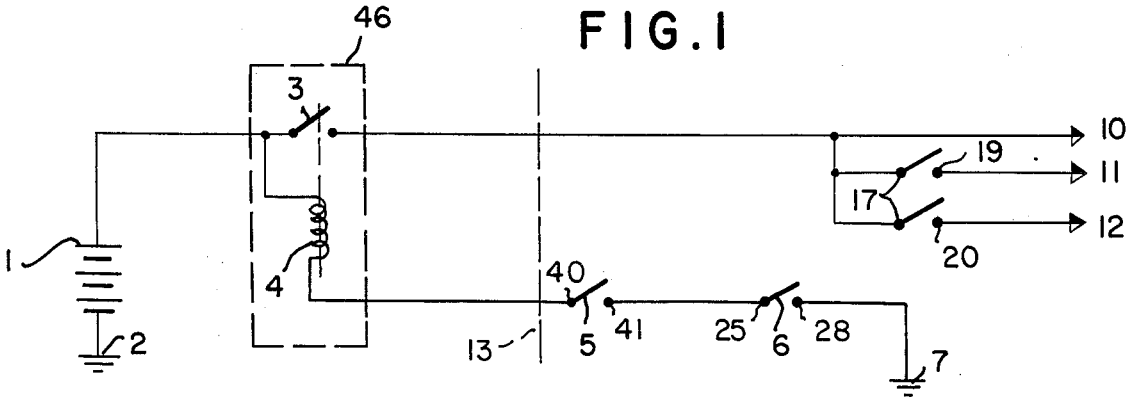
FIG. 3
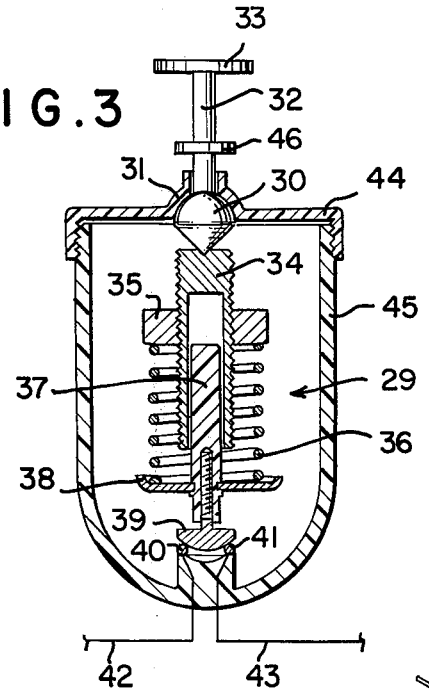
FIG. 4
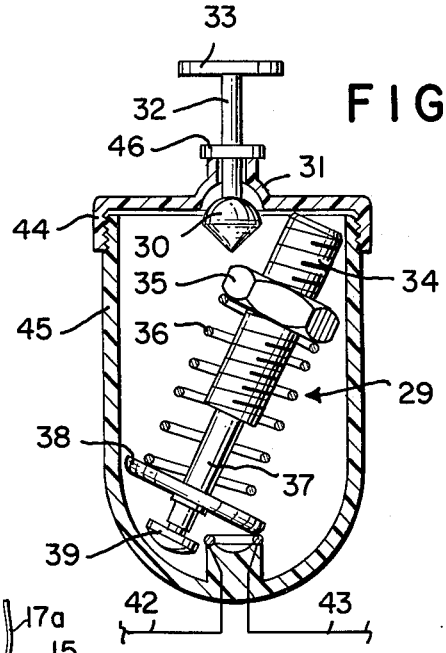
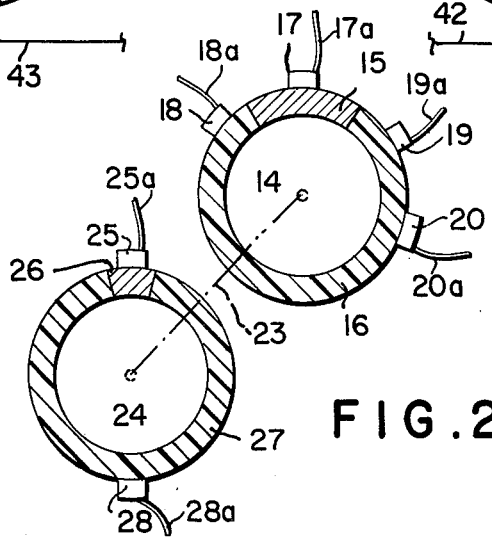
FIG. 2

VEHICULAR ELECTRICAL SAFETY APPARATUS

BACKGROUND OF THE INVENTION

1. The Field of the Invention

This invention relates to vehicular safety and anti-battery discharge devices and more particularly impact switches and circuitry associated thereto to disconnect the battery from the vehicle's ignition system and other electrical connections distributed throughout the vehicle, upon impact of sufficient intensity to the vehicle.

2. Description of the Prior Art

Heretofore, impact switches have been employed as safety devices. They have been installed so as to be in series with the battery thus rejoining the switch to carry all operating currents and on starting, carry the high starter current. The impact switches were not uniformly sensitive to all directions of impacts and those situations where the vehicle overturned. The prior circuitry sometimes permitted portions of the vehicle's electrical system to remain energized after the impact switch was trippened.

SUMMARY OF THE INVENTION

The combination of a battery main disconnecting relay isolating the vehicle's battery from the balance of the vehicle's electrical circuit, controlled by an impact switch uniformly sensitive to impacts at all angles and an additional circuit in the ignition switch enabling the operator to de-energize the main relay when the ignition key is in the "off" position.

A primary object is to completely disconnect the vehicle's electrical system when an impact occurs of sufficient intensity.

Another object of the invention is to virtually disconnect the entire vehicle's electrical circuitry when manually placing the ignition switch in the "off" position.

Still another object is to isolate the battery and main relay forward of the firewall from all other electrical circuits when the main relay is de-energized.

Another object is to provide for effective operation of the impact switch regardless of the angle of impact of the vehicle, upon being struck or striking another object.

A further object is to insure that the impact switch once operated will not allow the vehicle to be operated unless the switch is manually reset.

Still another object is to limit the possibility of fires occurring after a collision or impact by continuing the remaining active portion of the electrical system to a small space, closely interconnected and electrically disconnected from the balance of the electrical system.

BRIEF DESCRIPTION OF THE DRAWINGS

FIG. 1 is an electrical schematic incorporating the major elements of the disclosure.

FIG. 2 is a cross-sectional view of the ignition switch illustrating two discreet circuits and their associated contacts.

FIG. 3 is a cross-sectional view of the impact switch in the closed or operate position.

FIG. 4 is a cross-sectional view of the impact switch in the open or disabling position.

DESCRIPTION OF THE PREFERRED EMBODIMENTS

The structure and method of fabrication of the present invention consists of a vehicle's battery connected to one contact of a heavy duty relay with an electrical conductor of sufficient cross-sectional area to operate the entire electrical system of the vehicle. The other contact feeds the balance of the vehicle's electrical circuits. The relay must have its control coil energized to connect the contacts. When there is no coil current flowing the relay is biased mechanically to break the circuit between the contacts. The coil of the heavy duty relay can only be energized when the ignition switch is placed in the run, start or accessory position. When the switch is in the "off" position, the relay coil is de-energized. A special ancillary circuit is employed in the ignition switch isolated and separate from the circuits used to energize the starter, operate the ignition circuits, and various other circuits which are enabled only when the ignition switch is in some position other than the "off" position. An impact switch, which opens a normally closed circuit upon impact, has its contacts in series with the special circuit contacts of the ignition switch. The effect of an impact of sufficient intensity imparted to the switch at any angle, is identical to placing the ignition switch in the "off" position. The electrical circuit of the vehicle following impact is comprised of an open series circuit of the battery, connected to one contact of the main relay.

Now referring to the Figures, and more particularly to the electrical schematic illustrated in FIG. 1 which partially depicts a typical vehicular electrical system modified to include the main disconnecting relay 46 whose contacts 3 are closed when coil 4 is energized. Battery 1 has one terminal grounded at 2. Coil 4 is capable of being energized only when contacts 40 and 41 of impact switch 5 and the independent ancillary contacts 25 and 28 of the ignition switch 6 are closed. Ground connections 2 and 7 complete the coil 4 energizing circuit. When contact 3 is closed battery voltage relative to ground is available at 10 and the contacts 17 as shown. Similarly, battery voltage relative to ground will appear at 11 and 12 when contacts 17 are connected to contacts 19 and 20. Dotted line 13 depicts the firewall of the vehicle. When either impact switch 5 or the isolated ancillary or "floating" circuit of the ignition switch 6 is opened, coil 4 is de-energized and contact 3 opens disabling 10, 11, 12, and all circuits connected to them. If the impact switch alone is opened, all circuits, as shown, to the right of the firewall are disconnected fully from the battery, thus limiting the risk of fire on impact.

FIG. 2 illustrates the conventional ignition switch configuration 14 modified by the addition of the novel isolated switch circuit 24 by ganging an additional set of contacts 25 and 28 through a common shaft 23 to stationary switch contacts 17, 18, 19, and 20. As shown, the entire switch is in the "off" position. Contacts 25 and 28 comprise the switch 6 depicted in FIG. 1. Contact 17 is connected to the main bus at 10 in FIG. 1. Upon clockwise rotation of shaft 23 metallic contact material 15 annular in shape makes contact with contacts 17 and 19 in conventional fashion. Contact 19 enables the ignition circuit. Further clockwise rotation permits contact 20 to be additionally connected to 17, thus enabling the starter circuit, not shown. Insulating annular segment 16 keeps contacts 18, 19 and 20 isolated from contact 17 when the switch is in the neutral or "off" position, as shown. Upon rotating the switch counterclockwise up to and past the "off" position, contacts 19 and 20 are disconnected from each other and from contact 17. Sufficient counterclockwise rotation provides an electrical connection between 17 and 18. Contact 18 can be used to enable accessory vehicle circuits.

The novel switch segment 24 is comprised of an annular switch segment 27 and the insulating annular segment 26. Stationary contact 25 is floating when the shaft 23 is in the neutral or "off" position, as shown. Thus, stationary contact 28 is similarly floating or disconnected from contact 25. Angular rotation of shaft 23 either clockwise or counterclockwise will complete an electrical path between contacts 25 and 28. Contacts 25 and 28 comprise the switch 6 shown in FIG. 1. The angular displacements of contacts 17, 18, 19, 20, 25 and 28 are such that contacts 25 and 28 must connect when contact 17 is allowed to connect to either contact 18, 19, or 20. Wires 17*a*, 18*a*, 19*a*, 20*a*, 25*a*, and 28*a* connect to contacts 17, 18, 19, 20, 25, and 28 respectively and are used to fabricate the schematic representation shown in FIG. 1.

FIG. 3 illustrates the assembly 29 encased in a housing 44 and 45 in the operate or "closed" position and is the impact switch 7 of FIG. 1. Wires 42 and 43 are the terminals of the switch 7, and are connected to contact points 40 and 41, also shown as the switch 5 contacts in FIG. 1. Convex, metallic contact block 39 connect points 40 and 41 by virtue of the downward force exerted by expansion spring 36 as controlled by tensioning nut 35 fastened around the hollow threaded rod 34. Insulating shaft 37 is free to move axially within rod 34 and has an insulated flange 38 mounted transverse to the axis of the rod 34, such that the end of spring 36 urges the shaft 37 and the contact block 39 towards contacts 40 and 41. Pointed cam 30, seated in socket 31, engages the opening at the top of rod 34. The opening, engaging the pointed portion of the cam 30, may be made smaller than the diameter of shaft 37 to permit less secure engagement with the pointed portion of the cam 30. Impact lever 32 is rigidly fastened to cam 30 and is terminated in weight 33 at its free end. Upon impact, weight 33 tends to move away from the vertical position, as shown, as cam 30 is permitted to rotate within socket 31. When sufficient angular displacement of the pointed portion of the cam occurs, rod 34 becomes disenergized and is urged upwards and angularly displaced from the vertical direction. Contact block 39 will then disengage from contact points 40 and 41 breaking the electrical circuit between them. FIG. 4 illustrates the assembly 29 in the open circuited position due to contact block 39 dropping off from contacts 40 and 41. Flange 38 prevents any metallic contact between spring 36 and contacts 40 and 41. Flange 46, fastened to and transverse to the axis of lever 32, prevents dropping of cam 30 and lever 32 into the plastic housing 44 and creating accidental contact with the internal elements within the housing 44 and 45. The assembly comprised of 35, 36, 37, 38, 39 must be reset manually to re-establish electrical contact between points 40 and 41 by replacing contact block 39 in the position as shown in FIG. 1.

One of the advantages is the ability of the novel circuitry to completely disconnect the vehicle's electrical wiring from the battery upon impact.

Another advantage is the capability of manually selecting a position of the ignition switch which prevents accidental battery drainage.

A further advantage is the isolation of the battery and main disconnect relay from other electrical elements upon de-energization of the main relay coil.

Yet another advantage is provided by the ability to trigger the impact switch by a force of sufficient magnitude directed at any angle.

Another advantage lies in the inability to operate the vehicle unless the impact switch is purposely reset.

Thus, there is disclosed in the above description and in the drawings embodiments of the invention which fully and effectively accomplish the objects thereof. However, it will be apparent, to those skilled in the art, how to make variations and modifications to the instant invention. Therefore, this invention is to be limited not by the specific disclosure herein, but only by the appending claims.

The embodiments of the invention in which an exclusive privilege or property is claimed are defined as follows:

I claim:

1. Vehicular electrical safety apparatus comprised of two main normally open relay contacts interposed between one battery terminal and the balance of the vehicle's electrical wiring, wherein the coil of said relay is in series with an impact switch and an ancillary ignition switch circuit and connected to the terminals of said battery.

2. The vehicular electrical safety apparatus of claim 1 wherein said impact switch in the normal operating condition comprises a contact block in pressure contact with two contact points forming a closed electrical circuit, an expansion spring providing opposed force upon said contact block and a cam, pivotable lever means weighted at one end and fastened to said cam at the other, socket means providing a seat for said cam, said lever means axially parallel to said expansion spring, means to adjustably compress said expansion spring.

3. The vehicular electrical safety apparatus of claim 2 wherein said lever means uniformly pivotably responsive to impact forces directed radially at any angle transverse to the axis of said lever when in said normal operating condition.

4. The vehicular electrical safety apparatus of claim 1 wherein the ancillary ignition switch circuit is electrically independent from other electrically switched circuits comprising said ignition switch, means to close said ancillary switch circuit upon the closing of any of said other circuits, means to open said ancillary circuit upon the openings of all said other electrically switched circuits.

5. The ancillary switch of claim 4 comprised of annular ring having an insulating material form an arcuate portion thereof, to stationary electrical contacts angularly displaced from each other making contact with said ring and said insulating material and upon rotation of said ring and said insulating material said contacts electrically connecting with each other.

* * * * *